US006439180B2

(12) United States Patent
Groeger et al.

(10) Patent No.: US 6,439,180 B2
(45) Date of Patent: Aug. 27, 2002

(54) CYLINDER HEAD FOR A VALVE-CONTROLLED INTERNAL COMBUSTION ENGINE

(75) Inventors: Klaus Groeger, Hemmingen; Dietmar Schwarzenthal, Ditzingen, both of (DE)

(73) Assignee: Dr. Ing. h.c.F. Porsche AG, Stuttgart (DE)

( * ) Notice: Subject to any disclaimer, the term of this patent is extended or adjusted under 35 U.S.C. 154(b) by 0 days.

(21) Appl. No.: 09/765,398

(22) Filed: Jan. 22, 2001

(30) Foreign Application Priority Data

Jan. 21, 2000 (DE) ..... 100 02 512

(51) Int. Cl.[7] ..... F01L 1/34

(52) U.S. Cl. ..... 123/90.17; 123/90.31; 123/193.3; 123/193.5

(58) Field of Search ..... 123/90.15, 90.16, 123/90.17, 90.31, 193.5, 193.3

(56) References Cited

U.S. PATENT DOCUMENTS

| | | | | |
|---|---|---|---|---|
| 5,785,026 A | * | 7/1998 | Moriya | 123/90.17 |
| 5,954,019 A | * | 9/1999 | Yoshikawa | 123/90.17 |
| 6,044,816 A | * | 4/2000 | Buck | 123/90.17 |
| 6,076,492 A | * | 6/2000 | Takahashi | 123/90.17 |

FOREIGN PATENT DOCUMENTS

| | | | |
|---|---|---|---|
| DE | 41 43 153 A1 | | 7/1993 |
| EP | 0829 620 A2 | | 3/1998 |
| JP | 2000110534 | * | 4/2000 |

* cited by examiner

*Primary Examiner*—Thomas Denion
*Assistant Examiner*—Jaime Corrigan
(74) *Attorney, Agent, or Firm*—Crowell & Moring LLP

(57) ABSTRACT

A cylinder head for a valve-controlled internal combustion engine with a cylinder head housing, in which there are bearing blocks for the inlet or outlet camshaft. At least one camshaft has a camshaft adjuster, by way of which the position of the drive wheel of the camshaft can be changed relative to the axis of rotation of the camshaft. At least the bearing block, which is provided next to the camshaft adjuster and is intended for the camshaft, exhibits a segment, whose width is reduced owing to a recess for the screw connection of the cylinder head housing. The bearing site, arranged next to the camshaft adjuster, provides a bearing sleeve for the camshaft, in such a manner that the segment of the bearing block that is provided with a reduced bearing block width is expanded to the actual bearing block width. The sleeve exhibits openings to supply oil for the camshaft adjuster. Force-fed oil can be fed to the camshaft adjuster by way of the bearing sleeve over the bearing block, which is arranged next to the camshaft adjuster, despite the bearing block's recesses, which reduce its bearing width.

7 Claims, 3 Drawing Sheets

CYLINDER HEAD FOR A VALVE-CONTROLLED INTERNAL COMBUSTION ENGINE

BACKGROUND AND SUMMARY OF THE INVENTION

This application claims the priority of German Application 10002512.9, filed Jan. 21, 2000, the disclosure of which is expressly incorporated by reference herein.

This invention relates to a cylinder head for a valve-controlled internal combustion engine.

The European Patent Document EP 0 829 620 A2 discloses that valve-controlling camshafts are mounted by means of bearing sleeves in a cylinder head housing so as to rotate. Furthermore, the German Patent Document DE 41 43 153 A1 discloses that the is relative angular position between camshaft and the camshaft-driving sprocket wheel can be changed by means of so-called axial camshaft adjusters, thus changing the opening and closing times of the valves of the internal combustion engine.

Furthermore, it is known that cylinder head housings of engines have bearing blocks for the purpose of mounting the camshafts. Said bearing blocks exhibit a bearing block width that is decreased in segments owing to the screw-in openings for fastening the cylinder head housing to the cylinder head.

An objective of the present invention is to provide for such a cylinder head housing a compact camshaft mounting, which can simultaneously provide the force-fed oil for the camshaft adjuster, arranged at the camshaft.

This problem is solved by a cylinder head housing, in which there are bearing blocks for the inlet or outlet camshaft, at least one camshaft has a camshaft adjuster, by means of which the position of the drive wheel of the camshaft can be changed relative to the axis of rotation of the camshaft.

At least the bearing block, which is provided next to the camshaft adjuster and is intended for the camshaft, exhibits a segment, whose width is reduced owing to a recess for the screw connection of the cylinder head housing. The bearing site, arranged next to the camshaft adjuster, exhibits a bearing sleeve for the camshaft, in such a manner that the segment of the bearing site that is provided with a reduced bearing block width is expanded to the actual bearing block width, and the sleeve exhibits openings to supply oil for the camshaft adjuster.

The features, cited in the dependent claims, disclose other advantageous designs and improvements of the cylinder head, according to the invention.

The bearing sleeve is provided on its two face sides with a collar, which serves, on the one hand, the axial mounting of the camshaft and, on the other hand, the fixing in position of the bearing sleeve in the bearing block.

The bearing sleeve has on its peripheral surface openings, which serve to feed force-fed oil to a camshaft adjuster, fastened to the camshaft.

One embodiment of the invention is depicted in the drawings and is explained in detail below.

Other objects, advantages and novel features o f the present invention will become apparent from the following detailed description of the invention when considered in conjunction with the accompanying drawings.

DETAILED DESCRIPTION OF THE PREFERRED EMBODIMENT

Figure 1:
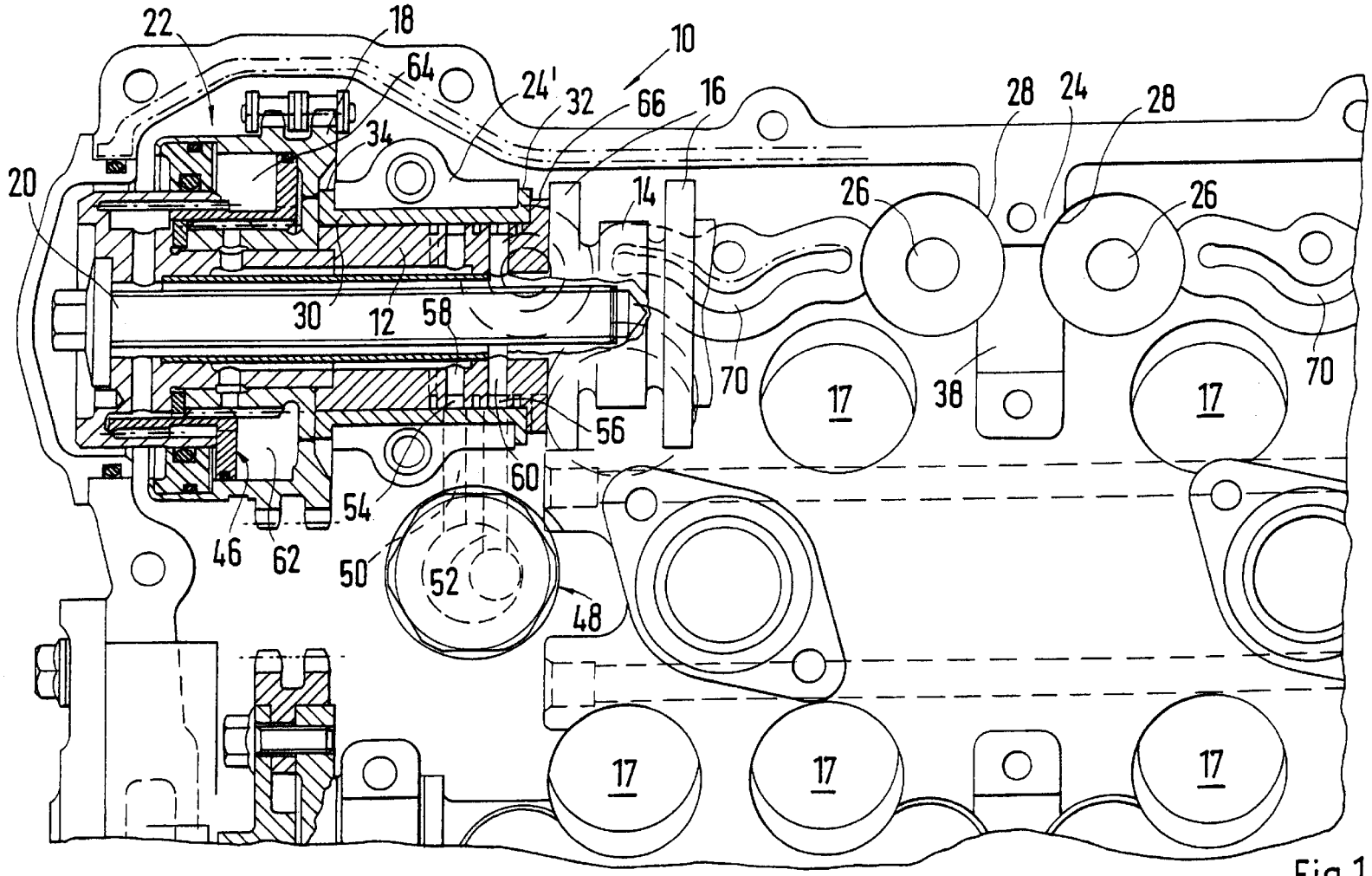
FIG. 1 illustrates the cylinder head housing of an internal combustion engine and part of the camshaft.
Figure 2:
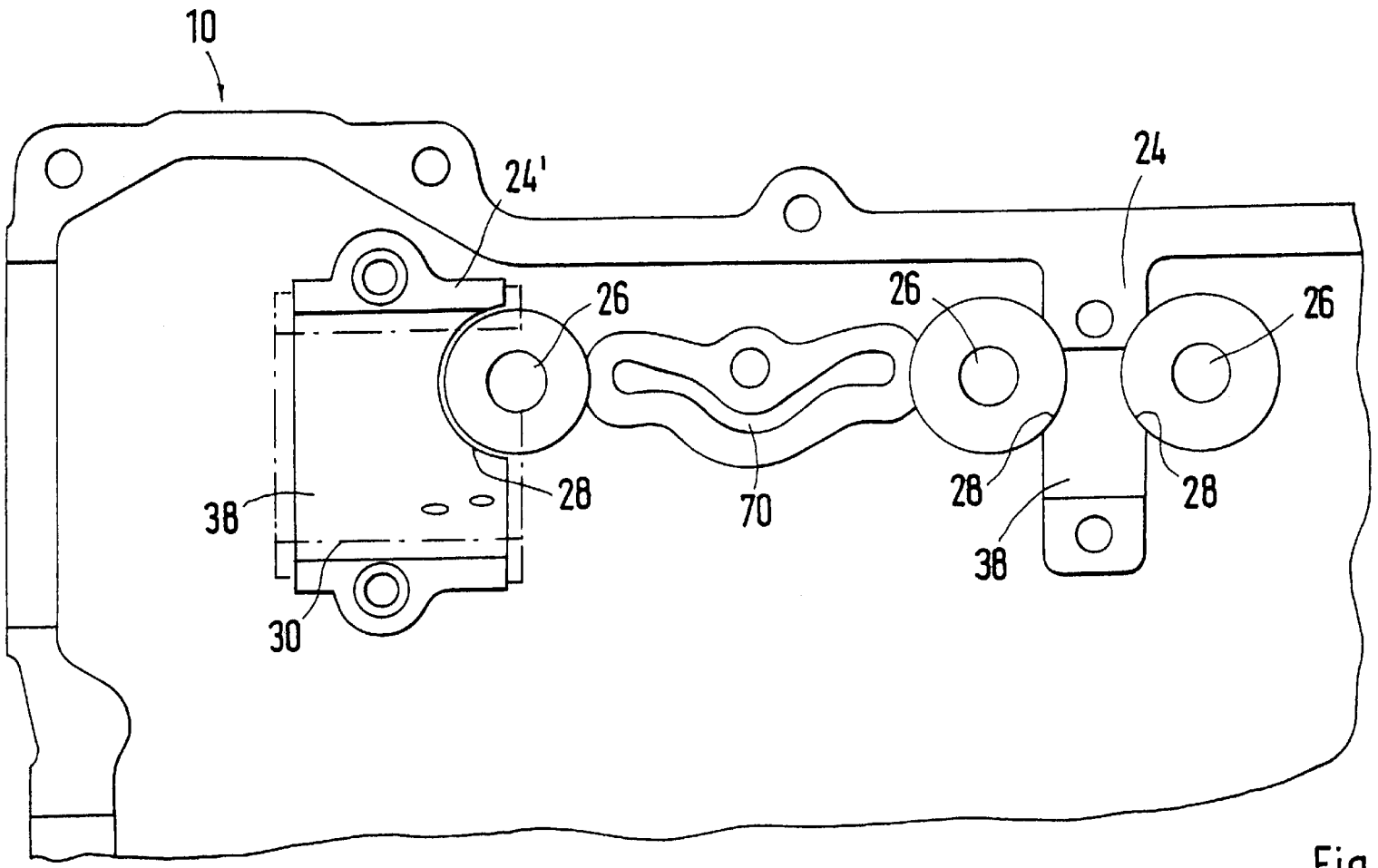
FIG. 2 illustrates a detail of the cylinder head housing without the camshaft.
Figure 3:
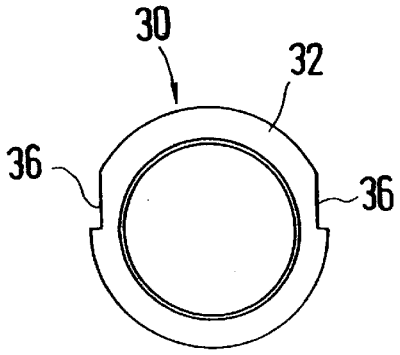
FIG. 3 shows a front view of the sleeve.
Figure 4:
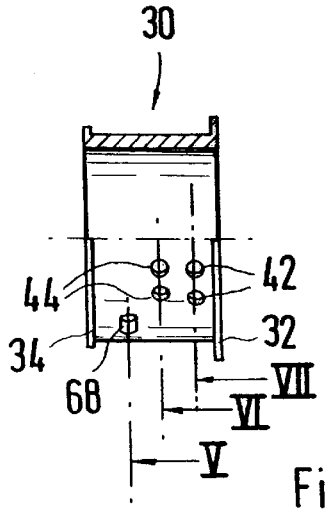
FIG. 4 shows a side view of the sleeve, of which its cross section is depicted to some extent.
Figure 5:
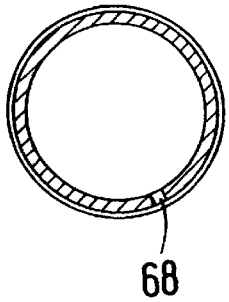
FIG. 5 shows a sectional view along line V in FIG. 4.
Figure 6:
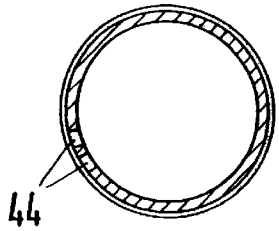
FIG. 6 shows a sectional view along line VI an FIG. 4.
Figure 7:
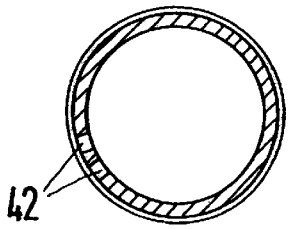
FIG. 7 shows a sectional view along line VII in FIG. 4.
Figure 8:
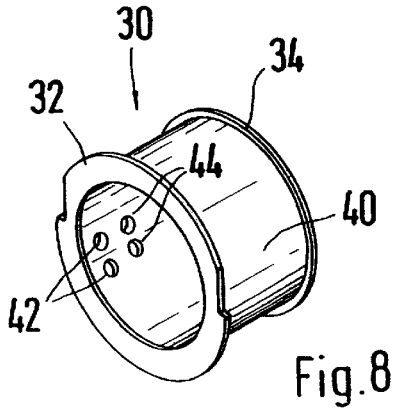
FIG. 8 shows a perspective view of the bearing sleeve.

As shown in FIG. 1, the camshaft 12, which is mounted in a cylinder head housing 10 so as to rotate, has two pairs of different cams 14 and 16, which define the valve lift and the opening and closing times of the inlet valves by way of bucket tappets (not illustrated), guided in the openings 17.

The camshaft 12 has on its outer face a sprocket wheel 18, which drives the camshaft 12 and is a component of an axial camshaft adjuster 22, fastened to the camshaft 12 by way of a screw bolt 20. The construction of the camshaft adjuster 22 is known from the state of the art and is described below only in connection with those features that are essential to the invention. The cylinder head housing 10 exhibits several bearing blocks 24, 24', in which the camshaft 12 can be rotated. The cylinder head housing 10 also has screw-in openings 26 for the purpose of fastening the cylinder head housing 10 to the cylinder head. Owing to the spatial conditions governing the design in the cylinder head housing 10, it is advantageous to provide the bearing blocks 24, 24' in the area of the screw-in openings 26 for the cylinder head screws with a radial recess 28, so that the non-illustrated cylinder head screws can be pushed into the screw-in openings 26 and screwed to the cylinder head.

The bearing block 24', arranged next to the camshaft adjuster 22, accommodates a bearing sleeve 30, which exercises the functions, described in detail below. As shown in FIGS. 38, the bearing sleeve 30 has on its outer face two collars 32 and 34. The collar 32 has two radially arranged recesses 36, which correspond in such a manner with the shoulders of the bearing block 24' that the bearing sleeve 30 is held twist-proof in the recess 38 for accommodating the camshaft 12. On a radial bearing surface 40, the bearing sleeve 30 includes two pairs of openings 42 and 44, by way of which force-fed oil can be guided to an internal final control member 46 of the camshaft adjuster 22. The force-fed oil is fed by way of a control valve 48 over force-fed oil lines 50 and 52, over radially revolving grooves 54 and 56 formed in the camshaft 12, and over boreholes 58 and 60, arranged in the camshaft 12, to the two pressure chambers 62 and 64, with whose aid the internal final control member 46 and the position of the sprocket wheel 18 can be adjusted, as desired, with respect to the position of the cams 14, 16.

The bearing sleeve 30, arranged in the bearing block 24', enlarges the bearing block in the area of the radial recess 28 of the bearing block 24' so that force-fed oil can be fed simultaneously to the camshaft adjuster 22 at this bearing site, arranged close to the camshaft adjuster 22. Furthermore, the bearing sleeve 30 serves to mount the camshaft 12 axially, since on the one side of the bearing block 24' the camshaft adjuster 22 rests flush against the collar 34 of the bearing sleeve 30; and on the other side of the bearing block 24' the collar 32 of the bearing sleeve 30 rests flush against a collar 66 of the camshaft 12. The bearing points of the camshaft 12 are designed as two parts, where the non-illustrated upper bearing shells are connected with corresponding screw connections to the bearing blocks 24, 24'.

The borehole 68, provided in the bearing sleeve 30, serves to supply lubrication for the camshaft bearing, whereas the oil channels 70, arranged in the cylinder head housing 10, are provided to supply the bucket tappets with lubricating oil.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A bearing block for a camshaft with a camshaft adjuster, said bearing block being arranged adjacent the camshaft adjuster and including a reduced width segment and a bearing sleeve for the camshaft to expand the bearing block in an area of the reduced width segment, wherein the bearing sleeve includes openings to supply oil for the camshaft adjuster.

2. A bearing block according to claim 1, wherein the bearing sleeve includes on each end a collar to axially mount the camshaft and to mount the bearing sleeve to the bearing block.

3. A cylinder head for a valve-controlled internal combustion engine comprising:

a cylinder head housing having bearing blocks for a camshaft, the camshaft including a camshaft adjuster, which changes a position of a drive wheel of the camshaft relative to the axis of rotation of the camshaft, and at least one bearing block, being arranged adjacent to the camshaft adjuster and being intended for the camshaft, including a segment, which has a reduced width due to a recess for a screw connection of the cylinder head housing, wherein the bearing block provides a bearing sleeve for the camshaft, so that the segment of the bearing block with the reduced width is expanded to the actual bearing block width, and wherein the bearing sleeve includes openings to supply oil for the camshaft adjuster.

4. A cylinder head according to claim 1, wherein the bearing sleeve includes on each end a collar, serving to axially mount the camshaft and the bearing sleeve.

5. A cylinder head according to claim 2, wherein at least one of said collars includes recesses, interacting with the shoulders of the bearing block so that the bearing sleeve is fixed and does not rotate.

6. A cylinder head according to claim 1, wherein at least one collar on the bearing sleeve includes recesses, interacting with shoulders of the bearing block so that the bearing sleeve is fixed and does not rotate.

7. A method of making a cylinder head for a valve-controlled internal combustion engine having at least one camshaft and a camshaft adjuster to axially position a drive wheel of the camshaft, comprising the acts of:

providing the cylinder head housing having bearing blocks for the camshaft located adjacent the camshaft adjuster, and a recess for a screw connection in the cylinder head housing, wherein at least one of the bearing blocks includes a reduced width segment to accommodate the recess, and expanding the reduced width segment of the bearing block by providing a bearing sleeve for the camshaft at the bearing blocks located adjacent the camshaft adjusters, wherein the bearing sleeve includes openings to supply oil for the camshaft adjuster.

* * * * *